US006832943B2

(12) United States Patent
Azad

(10) Patent No.: US 6,832,943 B2
(45) Date of Patent: Dec. 21, 2004

(54) HEAT SHIELD DESIGN FOR ARC TUBES

(75) Inventor: Farzin Homayoun Azad, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 48 days.

(21) Appl. No.: 10/065,744

(22) Filed: Nov. 14, 2002

(65) Prior Publication Data

US 2004/0095070 A1 May 20, 2004

(51) Int. Cl.[7] ..... H01J 9/00; H01J 9/24; H01J 9/40

(52) U.S. Cl. ..... 445/66; 445/22; 445/26; 445/43

(58) Field of Search ..... 445/26, 43

(56) References Cited

U.S. PATENT DOCUMENTS 3,628,846 A * 12/1971 Cortorillo ..... 445/43
4,827,190 A * 5/1989 Masui et al. ..... 313/638
4,868,457 A * 9/1989 Strok ..... 313/639
4,925,134 A * 5/1990 Keller et al. ..... 244/158 A
5,683,825 A * 11/1997 Bruce et al. ..... 428/698
6,126,887 A 10/2000 Ward et al. ..... 264/608
6,172,462 B1 1/2001 Gibson et al. ..... 313/594
6,306,515 B1 * 10/2001 Goedjen et al. ..... 428/469
6,354,901 B1 3/2002 Bundo et al. ..... 445/26
6,579,590 B2 * 6/2003 Ju et al. ..... 428/65.3

* cited by examiner

*Primary Examiner*—Nimeshkumar D. Patel
*Assistant Examiner*—Mariceli Santiago
(74) *Attorney, Agent, or Firm*—Jean K. Testa; Patrick K. Patnode

(57) ABSTRACT

The invention provides a method for sealing arc tubes while preventing cracking of the tube. The method comprises sealing a pair of electrodes on the arc tube in a furnace. A heat shield structure is used to reduce the thermal gradient generated by the sealing process. The heat shield comprises alternating layers of thermally conducting materials and thermally non-conducting materials.

19 Claims, 4 Drawing Sheets

| Description | Final Seal Length (mm) | Max. Hoop Stress (Mpa) | Max. Hoop Stress (% of 70W/TD Baseline) |
|---|---|---|---|
| 70W/TD Baseline | 5.8 | 92.79 | 100% |
| 70W/HP, Standard Shield | 5.8 | 130 26 | 140% |
| | 5.0 | 119 21 | 128% |
| | 4.8 | 117.08 | 126% |
| 70W/HP, Laminated Shield | 5.8 | 88.62 | 96% |
| | 5.0 | 81.66 | 88% |
| | 4.8 | 79 65 | 86%. |

FIG. 4

HEAT SHIELD DESIGN FOR ARC TUBES

BACKGROUND OF INVENTION

The invention relates generally to sealing of arc tubes, and more specifically to arc tubes used in ceramic metal halide (CMH) lamps. This invention relates particularly to a heat shield design and methods used in the sealing process of arc tubes.

Ceramic metal halide lamps are generally comprised of a polycrystalline alumina arc tube containing an ionizable fill and having a pair of main thermionic electrodes at the ends. A typical arc tube configuration comprises a central portion, often referred to as a hollow tube, and two arc tube legs attached to respective ends of the central portion. In most applications the electrodes include a relatively high percentage of tungsten. The electrodes are supported by inleads which typically include a thin niobium wire portion extending hermetically through a glass seal in the end of the lamp.

The sealing of the electrodes is typically done by placing the arc tube in a furnace of very high temperature. Certain CMH arc tube geometries are prone to cracking during the transient thermal process in which the electrode is hermetically sealed into the arc tube leg thus leading to yield loss in the manufacturing process.

Typically the body of the arc tube is made of polycrystalline alumina. When the arc tube is placed in the furnace, the high temperature causes the seal glass to melt and penetrate into the arc tube leg thus sealing the electrodes to the arc tube.

Another problem with the manufacturing process is that the arc tube experiences a large amount of hoop stress. Hoop stress usually refers to the stress that builds up around the circumference of the arc tube due to adverse temperature gradient. As a result, the arc tube begins to crack at the regions where maximum hoop thermal stress is experienced.

Therefore, what is desired is a heat shield structure that can be used in the manufacturing process that reduces the temperature gradient in the critical region of the arc tube and thus prevents cracking.

SUMMARY OF THE INVENTION

Briefly, in accordance with one embodiment of the invention, a heat shield structure is provided for use in sealing electrodes of an arc tube. The heat shield structure comprises a plurality of layers of alternating thermally conducting material and thermally non-conducting material. The heat shield prevents the arc tube from cracking when the electrodes are being sealed.

In another embodiment, a method is provided for sealing arc tubes while preventing cracking of the arc tube. The method comprises sealing a pair of electrodes on the arc tube. The sealing process is implemented using a furnace. The thermal gradient generated by the sealing process is reduced by implementing a heat shield in the furnace. The heat shield comprises alternating layers of thermally conducting materials and thermally non-conducting materials.

BRIEF DESCRIPTION OF DRAWINGS

These and other features, aspects, and advantages of the present invention will become better understood when the following detailed description is read with reference to the accompanying drawings in which like characters represent like parts throughout the drawings, wherein:

FIG. 4 is a table comparing the hoop thermal stress levels between a standard heat shield and the laminated heat shield as described in the invention.

DETAILED DESCRIPTION

Figure 1:
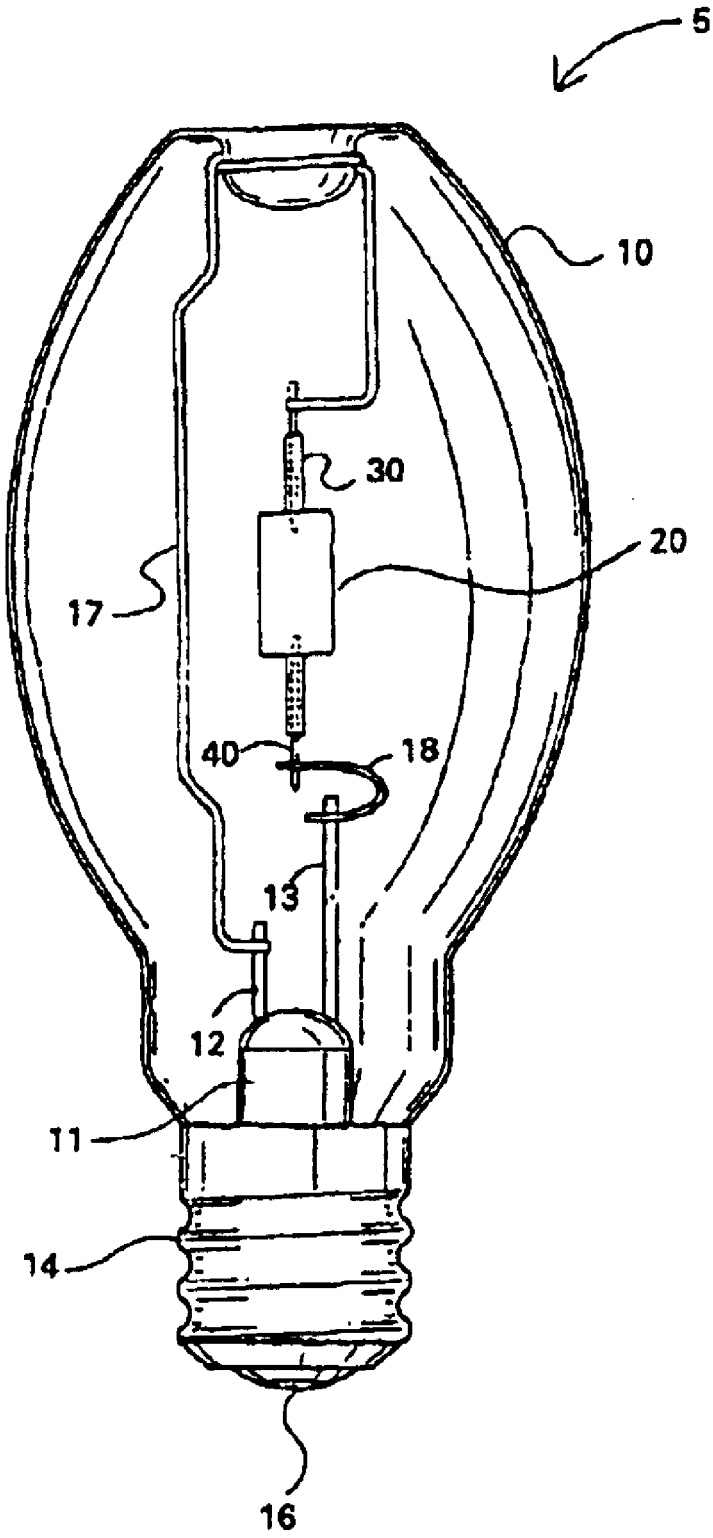
FIG. 1 is a diagrammatic representation of an example ceramic metal halide lamp.
Figure 2:
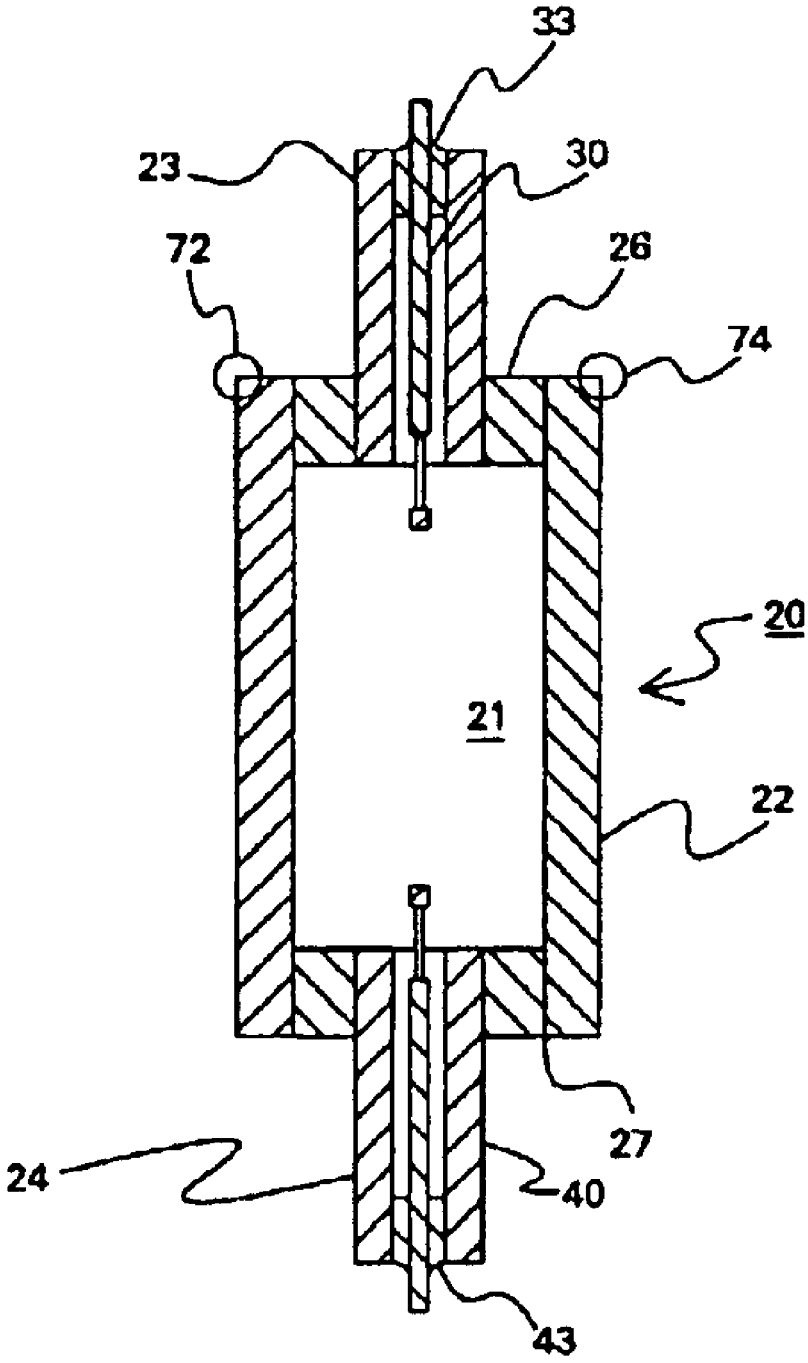
FIG. 2 is a diagrammatic representation of the a cross section of an arc tube.

FIG. 1 is a diagrammatic representation of an embodiment of a ceramic metal halide discharge lamp. Ceramic metal halide discharge lamp 5 comprises a glass outer envelope 10, a glass stem 11 having a pair of conductive support rods 12, 13 attached to the glass stem, a metal base 14, and a center contact 16 which is insulated from the base 14. The rods 12, 13 are connected to the base 14 and center contact 16, respectively, and not only support an arc tube 20 but supply current to electrodes 30, 40 via wire support members 17, 18. The structure of arc tube 20 is described in further detail below with reference to FIG. 2. FIG. 2 shows arc tube 20 in cross-section. The arc tube is shown comprising hollow tube 22, hollow plugs 26 and 27, arc tube legs 23 and 24, electrodes 30 and 40 and frits 33 and 43. Each component is described in further detail below.

Hollow tube 22 encloses a discharge space 21 and comprises an ionizable filling of an inert gas, a metal halide, and mercury. Hollow tube 22 comprises central apertures which receive hollow plugs 26, 27. In an embodiment, the arc tube legs 23, 24 comprise ceramic tubes, which receive electrodes 30, 40. Typically, the electrodes are sealed onto arc tube 20 using frits 33 and 43. The sealing process is usually performed in a furnace. Due to large heat generated in the furnace, the arc tube experiences large amounts of hoop thermal stress as shown in areas 72 and 74. Areas 72 and 74 experience excessive hoop thermal stress during the sealing process that cause the arc tube to crack.

Figure 3:
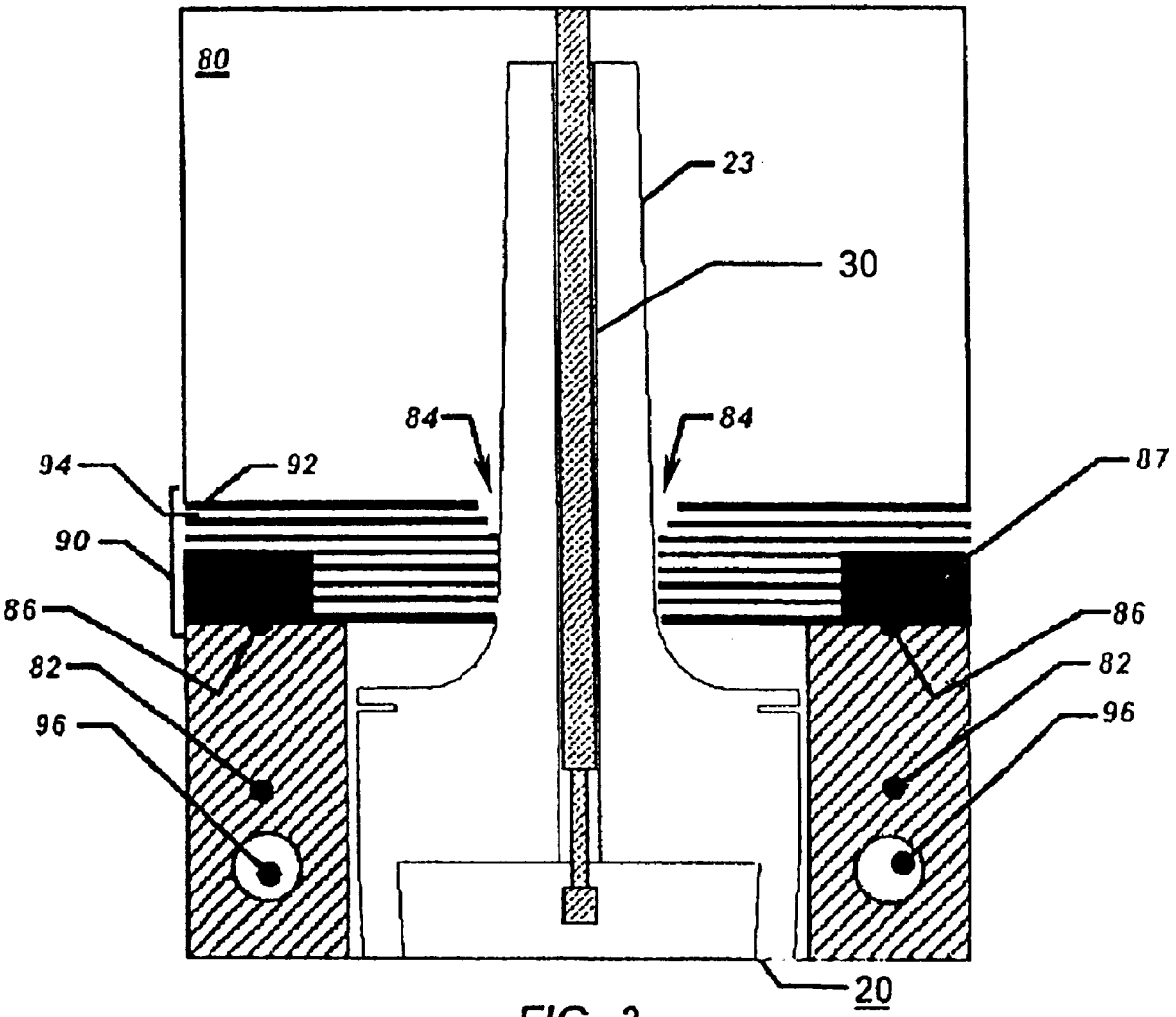
FIG. 3 is a diagrammatic representation of a heat shield implemented in a furnace in accordance with an aspect of the invention.

Accordingly, a method and a heat shield structure used to seal the electrodes while preventing the cracking of the arc tube is described below with reference to FIG. 3. FIG. 3 illustrates the sealing process where the arc tube is placed in furnace 80 to seal the electrode.

Referring further to FIG. 3, heat shield structure 90 is used in the sealing process. The heat shield comprises a plurality of layers of alternating thermally conducting material 92 and thermally non-conducting material 94. The alternating layers of conducting and non-conducting materials provides for a heat shield having a laminated structure.

In an embodiment, the thermally conducting material comprises a material from the group of refractory metals such as tungsten and molybdenum. Further in this embodiment, the thermally non-conducting material comprises a material from the group of high-temperature, thermally insulating materials argon, xenon, krypton, neon, zirconia, boron nitride, alumina, magnesia, calcia and any mixtures thereof. In a further embodiment, the thermally insulating material is tungsten and is of a thickness of 0.3 mm and the thermally non-insulating layer is a zirconia layer of 4.25 mm thickness.

During the sealing process, arc tube 20 (not shown in entirety, only arc tube leg 23 is shown) is first placed in carrier block 82. In an embodiment, the arc tube comprises a 70W hollow plug geometry. Electrodes 30 and 40 (not shown) are then inserted into the arc tube leg 23 and 24 (not shown) respectively. The frits are placed around the electrodes at the top of the arc tube leg (not shown).

Heat shield structure 90 is then placed on the carrier block 82 such that the arc tube leg 23 with the electrode 30 and frit protrudes through heat shield hole 84 in heat shield structure. In an embodiment, the carrier block comprises copper. Carrier block 82 holds arc tube 20 in place during the sealing process. The carrier block containing the arc tube is then moved into furnace 80. In the illustrated embodiment, furnace 80 comprises a cross-section representation of a typical seal furnace. As the temperature of the furnace is raised, the frit melts and flows into the gap between the electrode and the arc tube leg, thus forming a hermetic seal.

The sealing furnace above generates large amounts of heat. The heat shield structure is used to prevent the heat generated by the sealing process from reaching the arc tube body and thus preventing adverse thermal gradients in the critical regions 72 and 74 shown in FIG. 2, which cause cracking of the arc tube. In the illustrated embodiment, the heat shield structure comprises a plurality of layers of alternating thermally conducting material and thermally non-conducting material. The heat shield reduces the adverse temperature gradient in the critical region of the arc tube by enabling radially outward heat flow from the arc tube leg.

As described above, carrier block 82 holds arc tube 20 firmly in place, while the arc tube is placed in furnace 80. Thermal contact 86 is maintained between the heat shield and the carrier block to enable removal of the radially outward heat flow. In one embodiment, the thermal contact comprises physical contact of the lowermost conducting layer of the heat shield structure with the carrier block as shown by reference numeral 86. In the illustrated embodiment, thermal contact also comprises physical contact of a plurality of the bottom conducting layers of heat shield structure as shown by reference numeral 87.

The carrier block also maintains a low temperature of the arc tube body to prevent evaporation of the halide dose. In an embodiment, the carrier block comprises cooling fluid 96, such as water, ethylene glycol, helium, nitrogen. In another embodiment, the cooling fluid is water. The table comparing the hoop thermal stress level between a standard heat shield (using a GE Model 70W/HP CMH lamp) and a laminated heat shield (using a GE Model 70W/HP CMH lamp) as described above is shown in FIG. 4.

The table compares the maximum hoop stress for seal lengths of 5.8 mm, 5.0 mm and 4.8 mm respectively. It may be noted that the percentage of maximum hoop stress exceed one hundred percent when the standard shield is used and is less than one hundred percent of the standard case when the laminated heat shield is used thus indicating that the hoop stress is largely reduced by using the laminated shield.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A heat shield structure for use in sealing of an arc tube, said heat shield structure comprising:

a plurality of layers at alternating thermally conducting material and thermally non-conducting material, said layers being disposed about said arc tube to enable a radially outward heat flow during the sealing of said arc tube.

2. The heat shield structure of claim 1, wherein said thermally conducting material comprises refractory metals.

3. The heat shield material of claim 2, wherein said thermally conducting material is selected from the group consisting of tungsten, molybdenum.

4. The heat shield structure of claim 1, wherein said thermally non-conducting material comprises, high temperature, thermally insulating materials.

5. The heat shield structure of claim 4, wherein said thermally insulating material is selected from the group consisting of argon, xenon, krypton, neon, zirconia, boron nitride, alumina, magnesia, and calcia or any mixtures thereof.

6. The heat shield structure of claim 1, further comprising a thermal contact between said heat shield and a carrier block, said carrier block holding the arc tube in place while sealing, and said thermal contact maintaining a low temperature of the arc tube body to prevent evaporation of the halide dose.

7. The heat shield structure of claim 6, wherein said carrier block comprises a cooling fluid.

8. The heat shield structure of claim 7, wherein said cooling fluid is selected from the group consisting water ethylene glycol, helium, nitrogen.

9. The heat shield structure of claim 6, wherein said thermal contact comprises physical contact of a lower layer of said conducting material of said heat shield structure with said carrier block.

10. The heat shield structure of claim 6, wherein said thermal contact comprise physical contact of a plurality of layers of said conducting material of said heat shield structure with said carrier block.

11. The heat shield structure of claim 1, wherein said arc tube comprises a ceramic tube and a pair of arc tube legs attached at respective ends of said ceramic tube.

12. A method for sealing at least one arc tube while preventing cracking of said tube, said method comprising:

sealing a pair of electrodes on said arc tube, said sealing being implemented using a furnace; and implementing a heat shield adapted for reducing the thermal gradient generated in said furnace, said heat shield comprising alternating layers of thermally conducting materials and thermally non-conducting materials.

13. The method of claim 12, wherein said thermally conducting material comprises refractory metals.

14. The method of claim 13, wherein said thermally conducting material is selected from the group consisting of tungsten, molybdenum.

15. The method of claim 12, wherein said thermally non-conducting material comprises a high-temperature, thermally insulating material.

16. The method of claim 15, wherein said thermally non-conducting material is selected from the group consisting of argon, xenon, krypton, neon, zirconia, boron nitride, alumina, magnesia, calcia and any mixtures thereof.

17. The method of claim 12, further comprising maintaining thermal contact between said heat shield and a carrier block.

18. The method of claim 17, wherein said maintaining comprises maintaining physical contact of a lower layer of said conducting material of said heat shield structure with said carrier block.

19. The method of claim 17, wherein said maintaining comprises maintaining physical contact of a plurality of layers of said conducting material of said heat shield structure with said carrier block.

* * * * *